US005715854A

United States Patent [19]

Andrieux et al.

[11] Patent Number: 5,715,854

[45] Date of Patent: Feb. 10, 1998

[54] DOME-LIKE STRUCTURE AND KIT OF PARTS THEREFOR

[75] Inventors: Jean-Claude Andrieux, 1 McGill Street, Apt. 513, Montreal, Province of Quebec; Denis Goupille, Laplaine; Michel Leonard, 2720 O'Grady, Saint-Laurent, Province of Quebec; Marc-Constantin Marinescu, Montreal, all of Canada

[73] Assignees: Jean-Claude Andrieux, Montreal; Michel Leonard, Westmount, both of Canada

[21] Appl. No.: 629,758

[22] Filed: Apr. 9, 1996

[51] Int. Cl.[6] ..... E04H 15/16

[52] U.S. Cl. ..... 135/94; 52/81.5; 52/271; 52/592.1; 446/108

[58] Field of Search ..... 52/81.1, 81.4, 52/81.5, 82, 271, 589.1, 592.1, 592.3; 135/91, 93, 94, 117, 33.7; 446/108

[56] References Cited

U.S. PATENT DOCUMENTS

| | | | |
|---|---|---|---|
| 2,910,737 | 11/1959 | MacMillan | 52/81.1 |
| 3,284,969 | 11/1966 | Walters et al. | 52/81.4 |
| 3,768,218 | 10/1973 | Blaski | 52/81.5 |
| 3,820,292 | 6/1974 | Fitzpatrick | 52/81.5 |
| 3,921,555 | 11/1975 | Suzuki et al. | 52/81.1 X |
| 3,953,949 | 5/1976 | O'Sheeran | 52/82 |
| 3,959,830 | 6/1976 | van den Broek | 52/592.1 X |
| 3,972,163 | 8/1976 | Coperthwaite | 52/82 |
| 4,064,663 | 12/1977 | Moss | 52/81.1 |
| 4,068,421 | 1/1978 | Marovich | 52/81.4 |
| 4,098,536 | 7/1978 | Mills | 135/117 X |

FOREIGN PATENT DOCUMENTS

| | | |
|---|---|---|
| 2112025 | 6/1994 | Canada . |
| 2092842 | 9/1995 | Canada . |

*Primary Examiner*—Lanna Mai

*Attorney, Agent, or Firm*—Jones, Tullar & Cooper, P.C.

[57] ABSTRACT

A kit of parts for forming a structure which may be a play structure or a shelter, and which is at least partially of dome-like shape and which can resemble an igloo, comprises a series of side panels of generally trapezoidal shape each with side edges which are at least partially bowed outwardly and are capable of being joined edge-to-edge to adjacent side panels when curved to conform to said dome-like shape. The side panels are longitudinally flexible, and each has an upper end portion which is pleated to allow the upper edges of panels to be pushed together as the panels are joined. A convex top closure is provided for fitting over the top edges of the panels, and the pleated upper end portions allow ventilation around the edges of the closure.

14 Claims, 11 Drawing Sheets

DOME-LIKE STRUCTURE AND KIT OF PARTS THEREFOR

BACKGROUND OF THE INVENTION

1. Field of the Invention

The present invention relates to a structure of partially dome-like shape, assembled largely of plastic panels. The structure may resemble an igloo, and may be used as a play structure, primarily for winter play. The structure can also be provided with decorative covers which allow it to resemble a space ship, hunting hut, etc, and may be suitable for year round use, as a play structure or otherwise. In addition to play, the structure can be used as a temporary shelter, for example for hunters, ice fishermen, or can be used as a blind.

2. Prior Art

Some play structures are known which can be assembled of plastic parts or panels. The panels may have edge formations with interengaging parts which can be assembled by relative sliding of the panels, for example as in Canadian Patent Application No. 2,112,025 to Rodrigues-Ferre. However, none appear to have been made which resemble an igloo, or any kind of dome-shaped structure. The present invention provides a partially dome-shaped structure which can be used for many purposes, including as a play house, and which is easy to assemble and reasonably strong. Other components are also provided, for example tunnel sections which can be used to connect several of the structures together.

SUMMARY OF THE INVENTION

According to the present invention, a kit of parts for forming a structure of at least partially dome-like shape comprises a series of side panels which are generally trapezoidal and have side edges which are at least partially bowed outwardly and are capable of being joined edge-to-edge to adjacent side panels when longitudinally curved to the dome-like shape. Preferably, the panels are initially flat and longitudinally flexible, and have an upper end portion which is formed with pleats to allow upper side edges of the panels to be pushed together as the panels are assembled and bent to the required dome-like shape. The upper edges of the panels, when assembled, define a circular opening, and a cover for this opening is provided which cooperates with the pleats to provide ventilation openings.

The panels may be held together at their edges by formations including an undercut groove or guideway in one edge of each panel, and an enlarged beading or bulge at the other edge of the panel suitable for sliding into and being retained by the undercut guideway at the side of an adjacent similar panel. The undercut guideway may be in the form of a partially circular elongated recess in a knuckle formation along the one edge of a panel.

One or more of the panels may have a face with grooves or other lines of weakening defining the outline of a window, the material along the line of weakening being easily cut for removing an area of the panel to form a window opening; the kit of parts may also include transparent window components for fitting into the window opening. Also, portions of one panel may be made removable or suitable for cutting away to allow insertion of an entranceway. The entranceway may be provided as a preformed component, along with components providing segments of a tunnel suitable for attachment to the entranceway.

BRIEF DESCRIPTION OF THE DRAWINGS

A preferred embodiment of the invention will now be described by way of example with reference to the accompanying drawings, in which.

DETAILED DESCRIPTION

Figure 1:
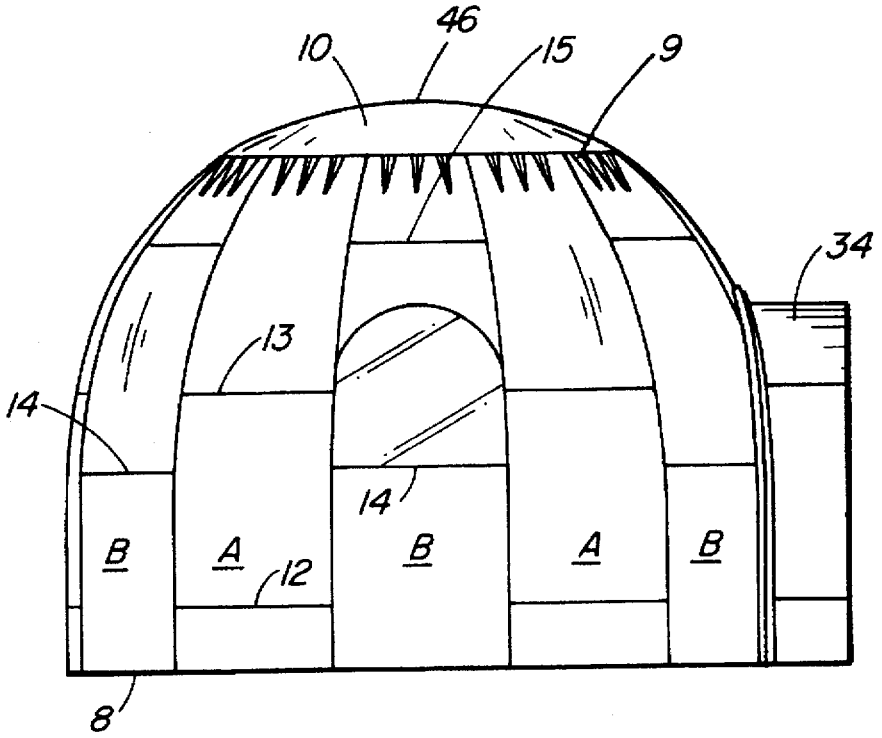
FIG. 1 is an elevation of a structure in accordance with the invention, suitable as a play structure.
Figure 2:
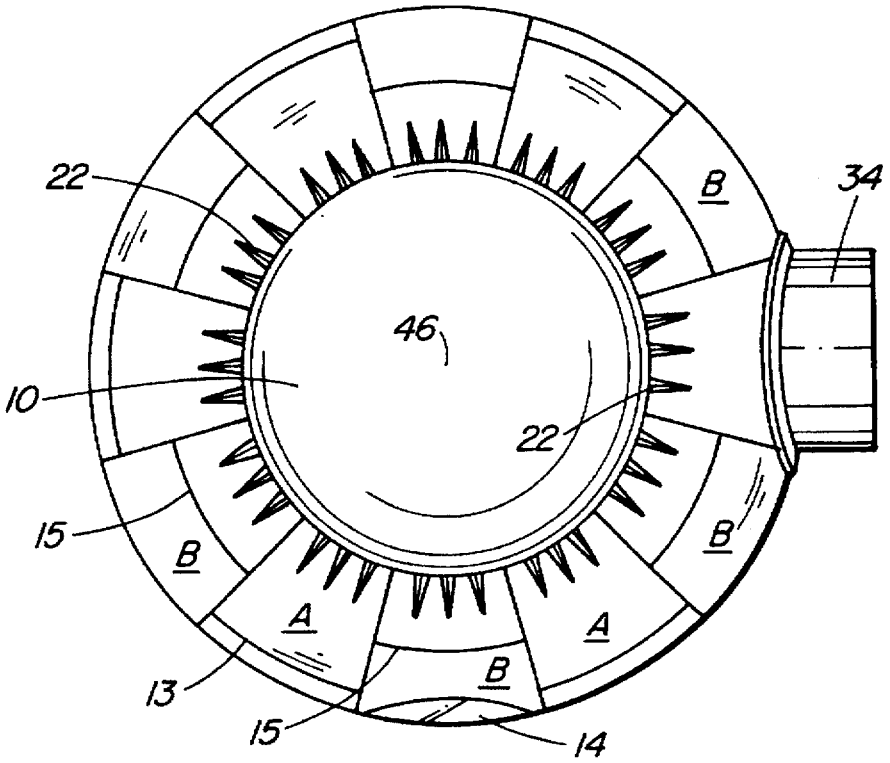
FIG. 2 is a plan view of the same structure.

The structure as shown in FIGS. 1 and 2 is largely formed from twelve side panels of two slightly different designs, shown as panels A and B, the two types of panels being alternated around the structure so that six of each type are used. Each panel extends from a lower end 8 in contact with the ground to an upper edge 9 which is overlapped by a shallow dome-shaped top closure 10 described in more detail below. When fitted together, the panels A and B have an upper portion of about ⅔ of their height curved longitudinally inwards with a continuous curvature so that the upper ⅔ or so of the structure is of roughly hemispherical dome shape and the whole structure is in the shape of an igloo. Each of the panels A and B has on its outer surface two horizontal transverse ribs 12, 13, 14, 15 which strengthen the panels laterally, and which also simulate the appearance of the edges of snow blocks such as they might be used in an igloo. A main difference between panels A and panels B is that the ribs of panels A are well below the level of the ribs of panels B.

Figure 3:
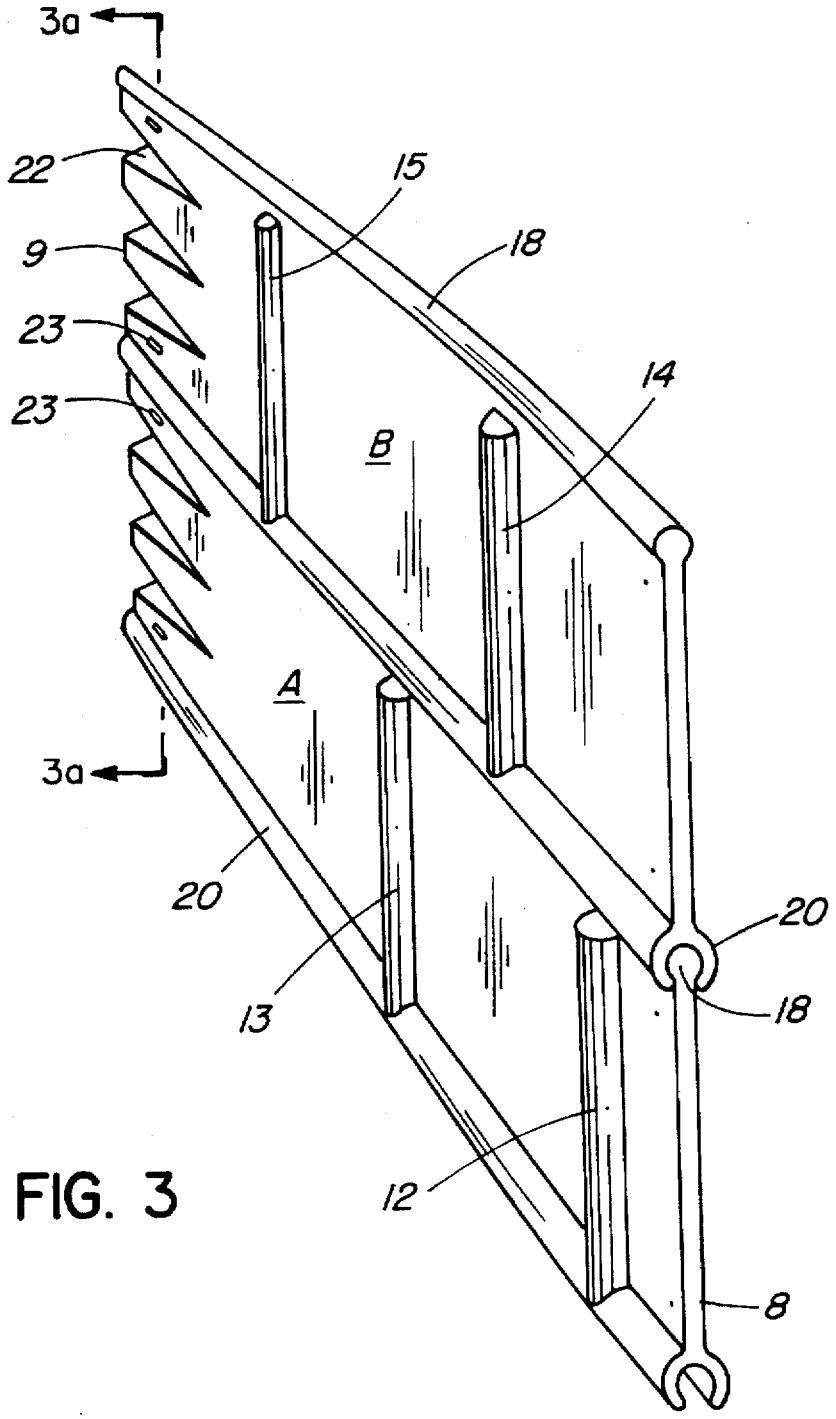
FIG. 3 is a view of two adjacent panels joined together edge-to-edge.

FIG. 3 shows more details of the panels A and B. As shown, each panel has on its right-hand side (viewed from the outside of the panel) an enlarged edge formation in the form of a bulge or beading 18, having an elongated cylindrical cross section which is enlarged relative to the panel thickness, and on its left-hand side has an edge formation in the form of a further enlarged beading or knuckle 20 which has an axial groove or recess of cylindrical undercut shape forming a guideway for slidably receiving the beading 18 of a similar adjacent panel. The undercut nature of the groove or recess in knuckle part 20 cooperates with the beading 18 of an adjacent panel to prevent the panels being pulled apart. The edge formations of the two panel types A and B are the same.

Figure 3A:
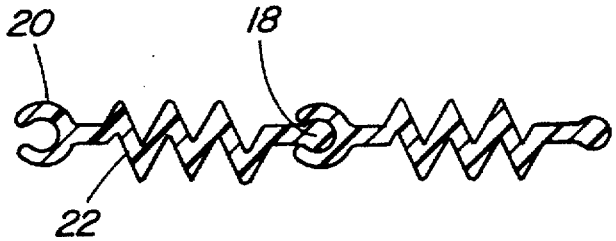
FIG. 3*a* is a sectional view on upper end portions of the two adjacent panels, on lines 3*a*—3*a* of FIG. 3.
Figure 4A:
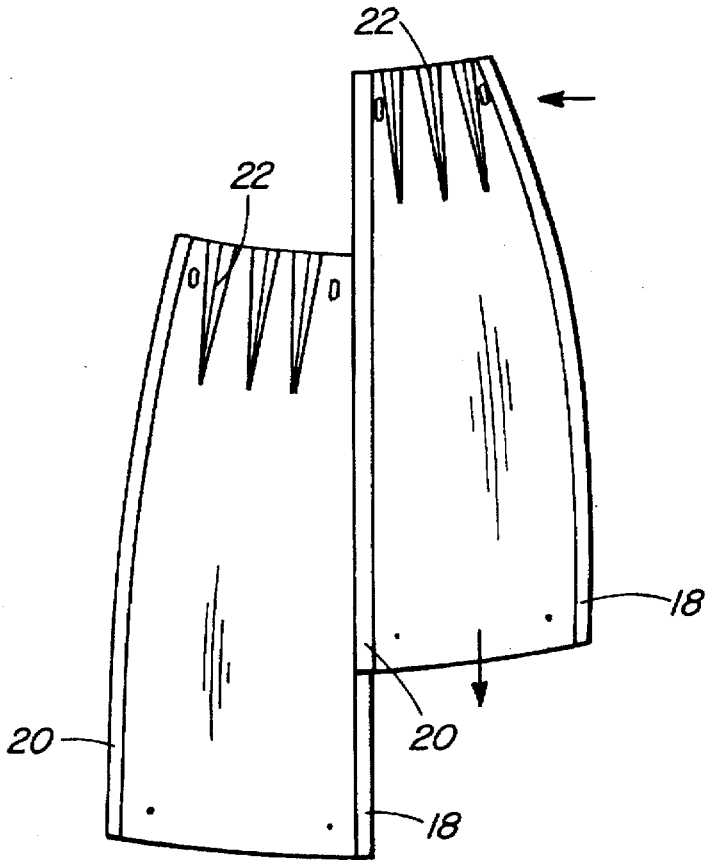
FIGS. 4*a* and 4*b* are successive views of two adjacent panels being assembled together.
Figure 4B:
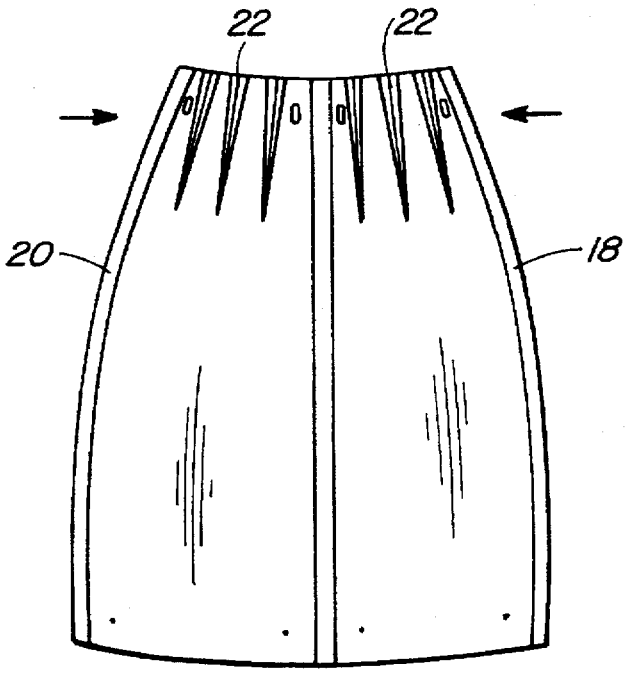

Each panel A and B is basically of elongated trapezoidal shape, but in each case the sides are slightly convex or outwardly bowed. Also, each panel, although initially flat, is made of flexible plastic material which allows it to be flexible along its length and to be bent longitudinally. To provide the panels with enhanced flexibility at their upper end portions, these portions are provided with pleats 22 as shown in cross-section in FIG. 3*a*. Seen in cross-section the pleats define between them acute angles and are laterally compressible to allow upper side edges of the panels to be pressed together as the panel is bent to assemble the structure. FIGS. 4*a* and 4*b* show (as viewed from the inner sides of the panels) how two adjacent panel edges are brought into alignment with each other by bending of the panels longitudinally into an arcuate form suitable for the convex dome shape of the structure while being slid together. The edge formations and the outward bowing of the side edges assist in bending the panels longitudinally during their assembly.

The upper end portions of the panels have bores 23 for attachment of the top closure 10, to be described below.

Figure 5A:
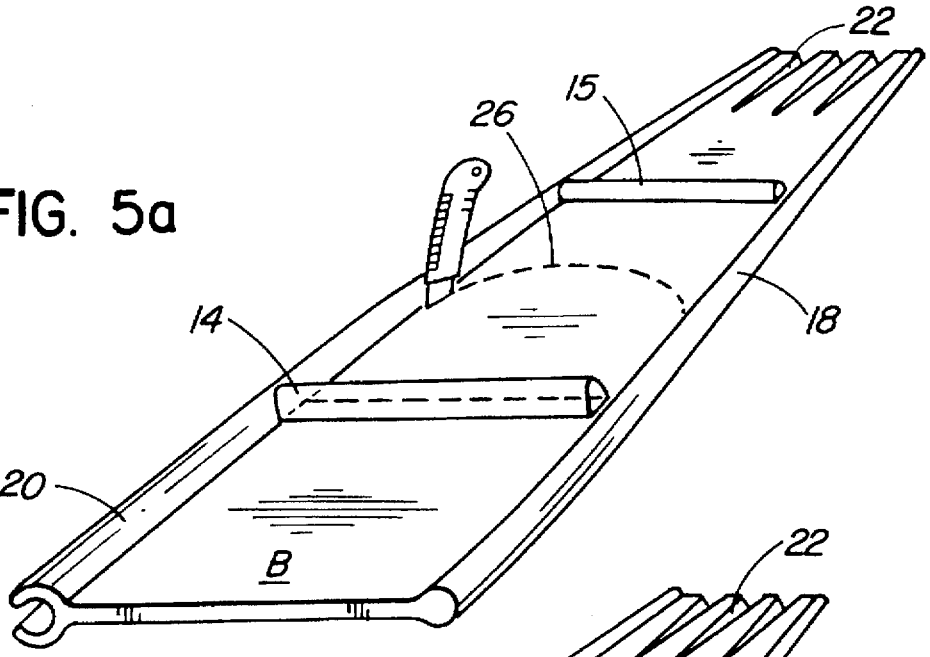
FIGS. 5*a* and 5*b* are successive views of a panel during cutting out of a window opening.
Figure 5B:
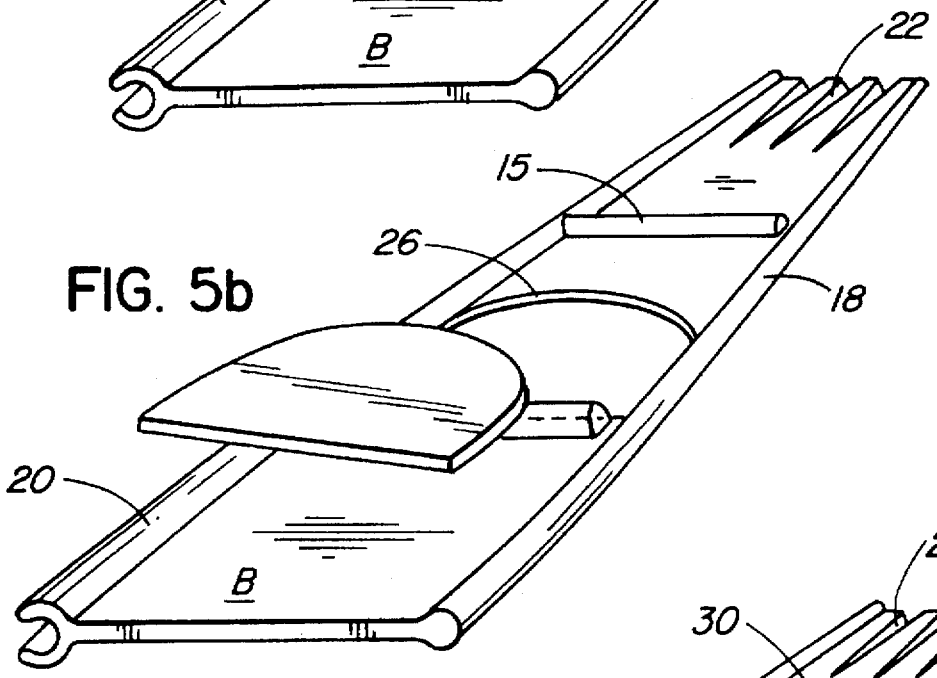

FIGS. 5*a* and 5*b* show successive stages in the formation of a window opening in one of the panels B. The panels B are provided with a groove which forms a line of weakening on their inner surfaces, the location of which is indicated at 26 in FIG. 5*a* and which defines the shape of a cut-out for a window. This groove is shown as extending firstly transversely of the panel just above the upper edge of rib 14, then up inside the beading 18, and then arching across the panel to the knuckle 20, and finally back down to rib 14. As indicated in the drawings, a person assembling the structure can form the window opening in any of the B panels by cutting along this groove with a utility knife.

Figure 6:
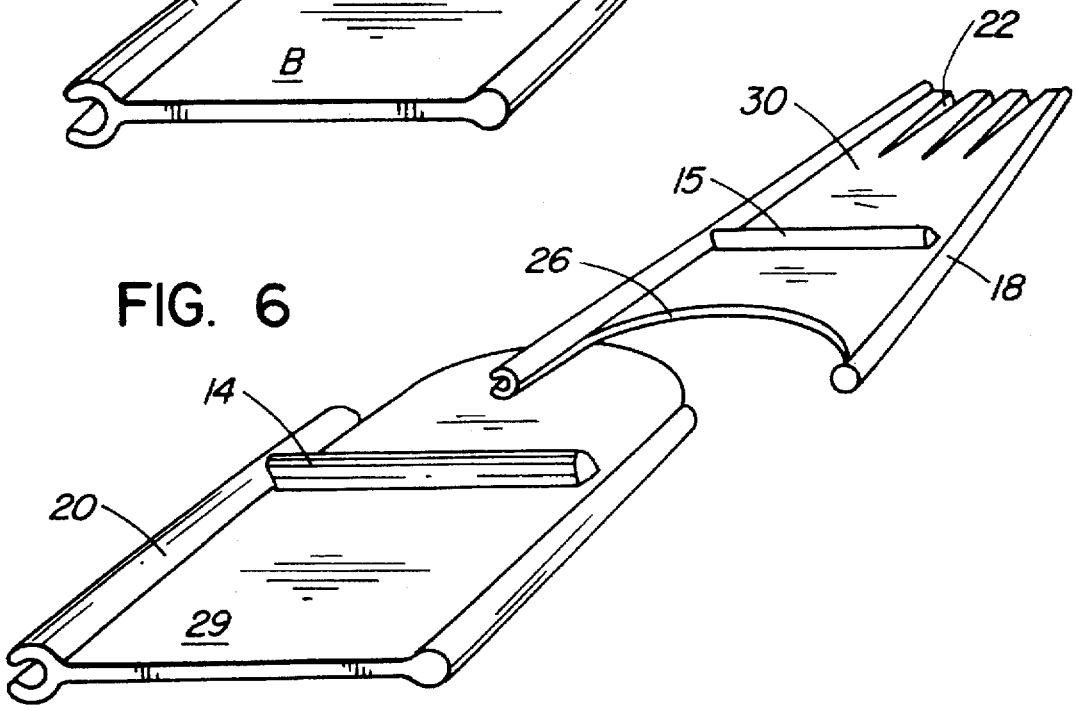
FIG. 6 is view of a panel which has been cut to accommodate an entranceway.

FIG. 6 shows that, instead of providing a window opening, one panel can be cut in such a way that an upper portion of this panel can be fitted over an entranceway. For this purpose, only the upper part of the groove indicated at 26 between the beading 18 and knuckle 20 is cut, and then the beading and knuckle edge formations can be cut through with a saw at the point where the groove 26 meets these formations, which is between ribs 14 and 15, and the lower part 29 of the panel is then removed to leave an upper panel portion 30 suitable for accommodating an entranceway underneath.

Figure 7:
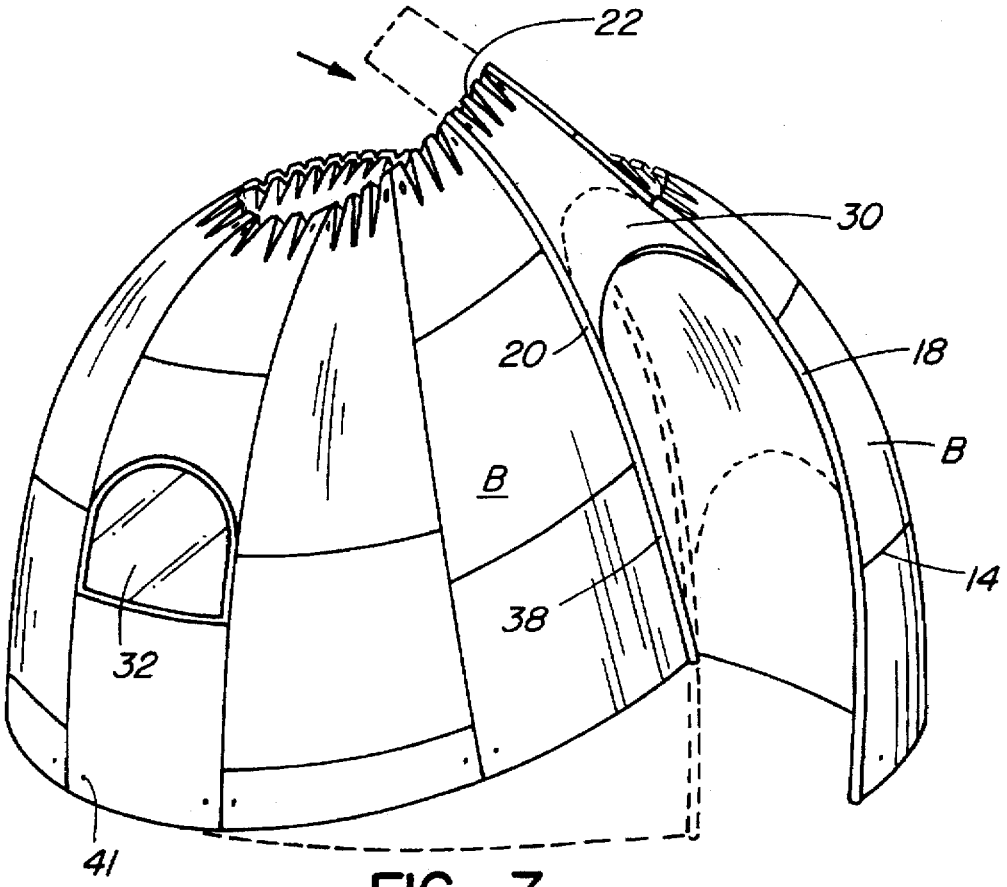
FIG. 7 is a view during assembly of the structure.
Figure 8:
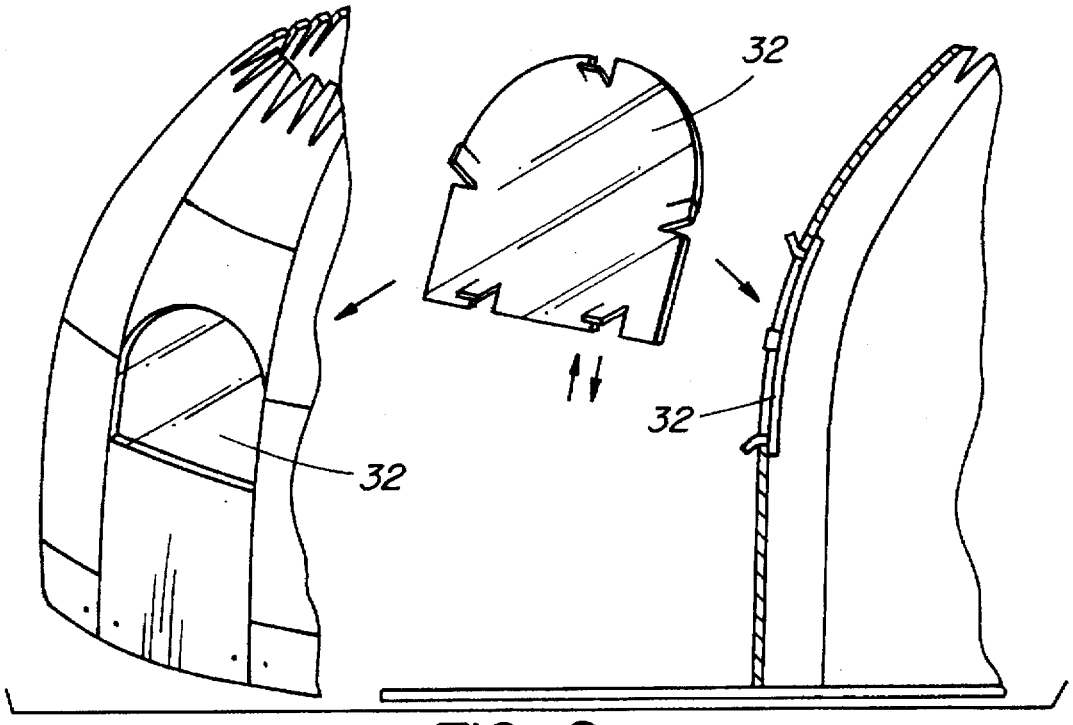
FIG. 8 is a view showing the insertion of a window panel.

FIG. 7 shows assembly of the panels of the structure. As indicated, the structure is assembled by firstly fitting together all of the panels except the last panel portion 30, which is subsequently slid into place while the adjacent panels are lifted and twisted slightly to receive it. The compressibility of the pleats 22 makes this reasonably easy. As shown in FIGS. 8 and 9, the window opening may then be fitted with a transparent window 32, and a preformed entranceway 34 may then be fitted in place under panel part 30.

Figure 9A:
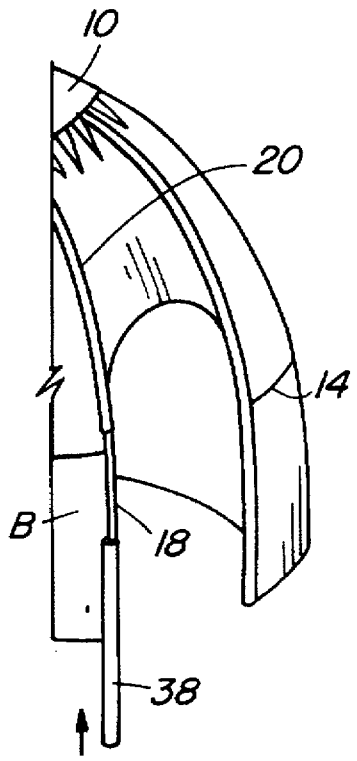
FIGS. 9*a*, 9*b*, and 9*c* are successive views of the fitting of an entranceway to the structure.
Figure 9B:
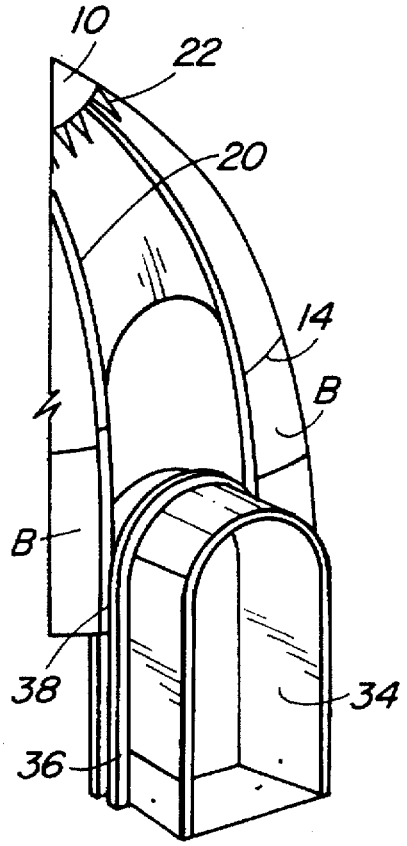
Figure 9C:
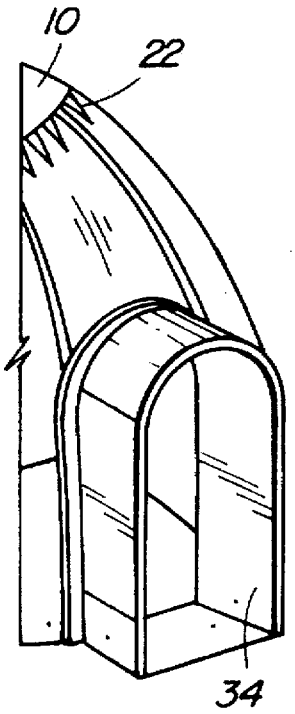
Figure 10:
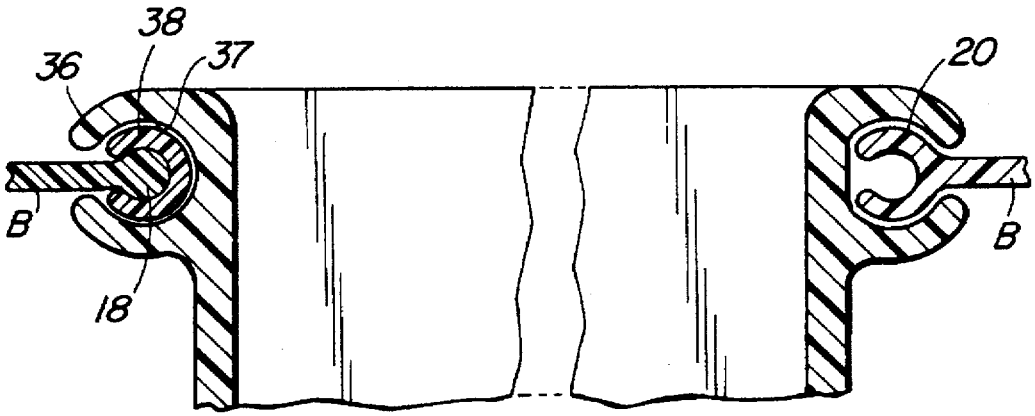
FIG. 10 is a sectional view through joints which hold the entranceway to the structure.

As shown in FIGS. 9 and 10, the entranceway is an arched member similar to a short tunnel section, and near to its inner end it has a flange element 36 extending up each side and over its top, this flange element having a central groove 37 which engages with sides of the aperture in the structure formed by the edges of two panels A and the lower edge of panel portion 30. The groove 37 is suitable for fitting onto the knuckle formation 20 on one side of the panel A, but this groove is of course much larger than the beading 18 on the adjacent edge of the left hand side panel. To provide for a good fit on this edge, a slotted sleeve 38 is fitted onto the beading 18 on the lower part of the left hand panel, as indicated in FIG. 9*a*, before the structure and the entranceway are fitted together. The entranceway can be closed by pushing into place the panel portion 29 removed from panel 30.

Figure 11:
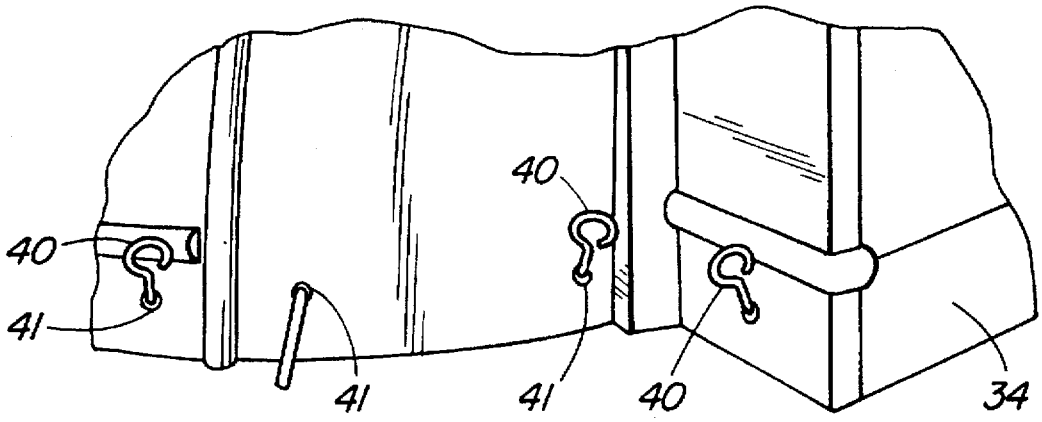
FIG. 11 is a view of ground fasteners holding the structure in place.

FIG. 11 shows how ground fasteners 40, similar to tent pegs, may be inserted in holes 41 at the bottom of the structure, including the entranceway, to hold this in place on the ground.

Figure 12:
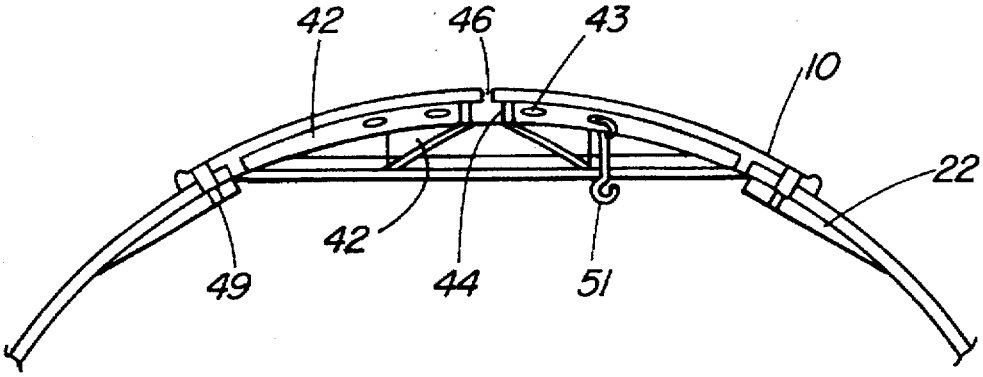
FIGS. 12, 12*a*, 12*b*, and 12*c* are views of a top closure and its attachment to the structure.
Figure 12A:
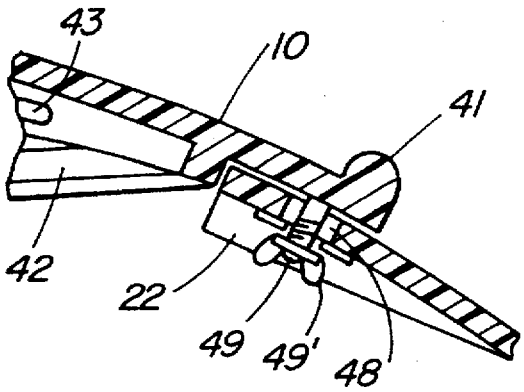
Figure 12B:
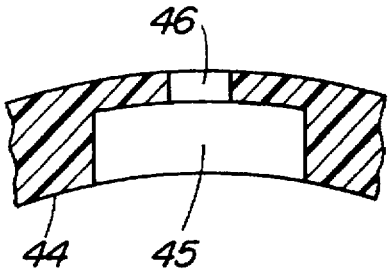
Figure 12C:
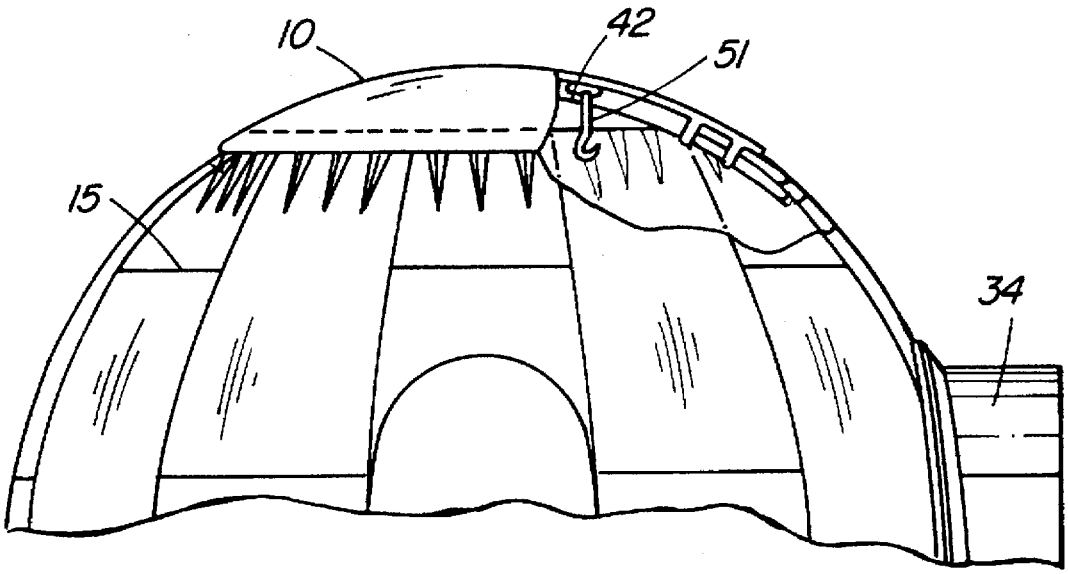
Figure 13:
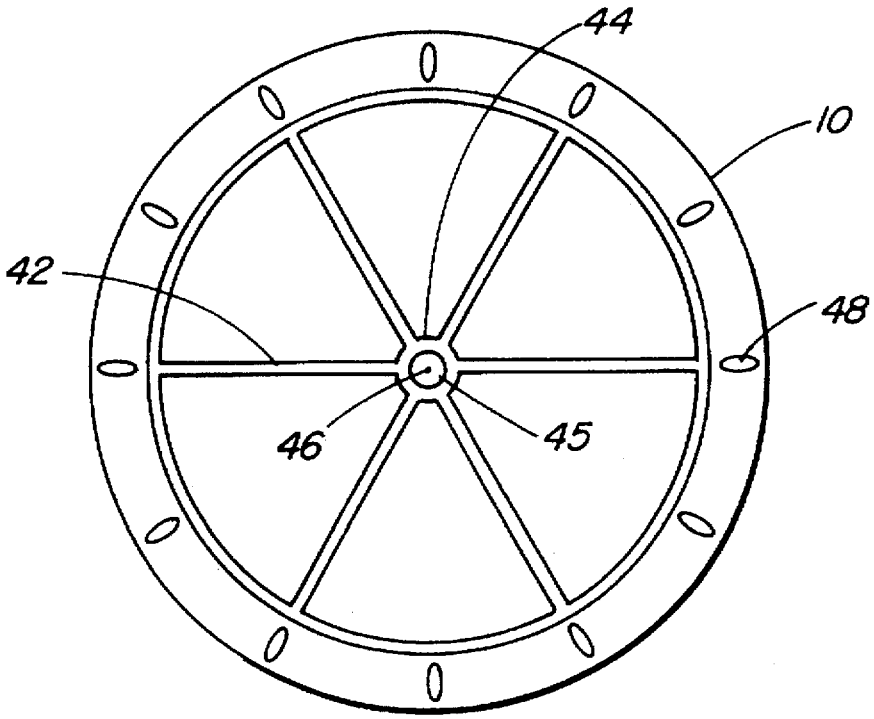
FIG. 13 is an underside view of the top closure.

FIGS. 12, 12*a*, 12*b*, and 12*c* show sectional and fragmentary views of the top closure 10, the underside of which is shown in FIG. 13. As shown, this is a molded plastic part having a top surface which is smoothly curved to conform to the generally spherical curvature of the top of the structure, and the underside of which has radial ribs 42 extending from a central hub 44. The top surface terminates in circumferential rib 41. As shown in FIG. 12*b*, the central hub 44 has an inner recess 45 leading to a central aperture 46, which may accommodate a post as described below. At its outer periphery, the closure 10 has a series of elongated bores 48 which, when the parts are erected, correspond in position with bores 23 in the upper end portions of panels A and B, and bolts 49 with wing nuts 49' are provided for passing through these bores and holding the top closure in place. The ribs 42 have apertures 43 which hold the upper ends of plastic hooks 51 which can be used to suspend objects within the structure.

It may be noted that the top closure when in place overlaps the upper ends of the panels to exclude rain, while the pleats 22 ensure that there is ventilation into the structure.

Figure 14:
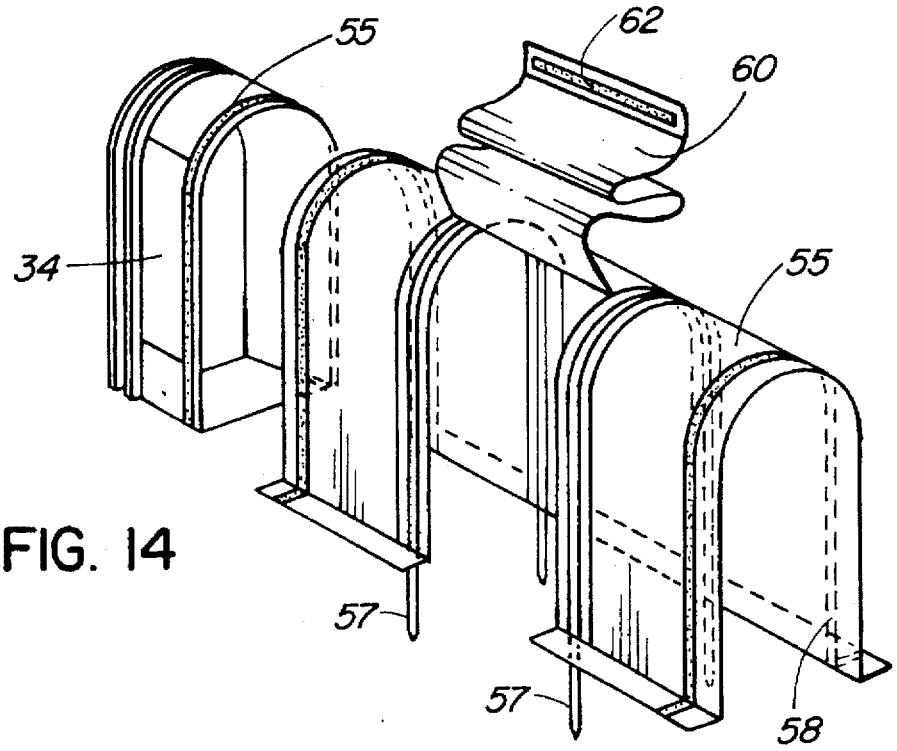
FIGS. 14 and 15 are perspective views of tunnel components for joining two of the structures.
Figure 15:
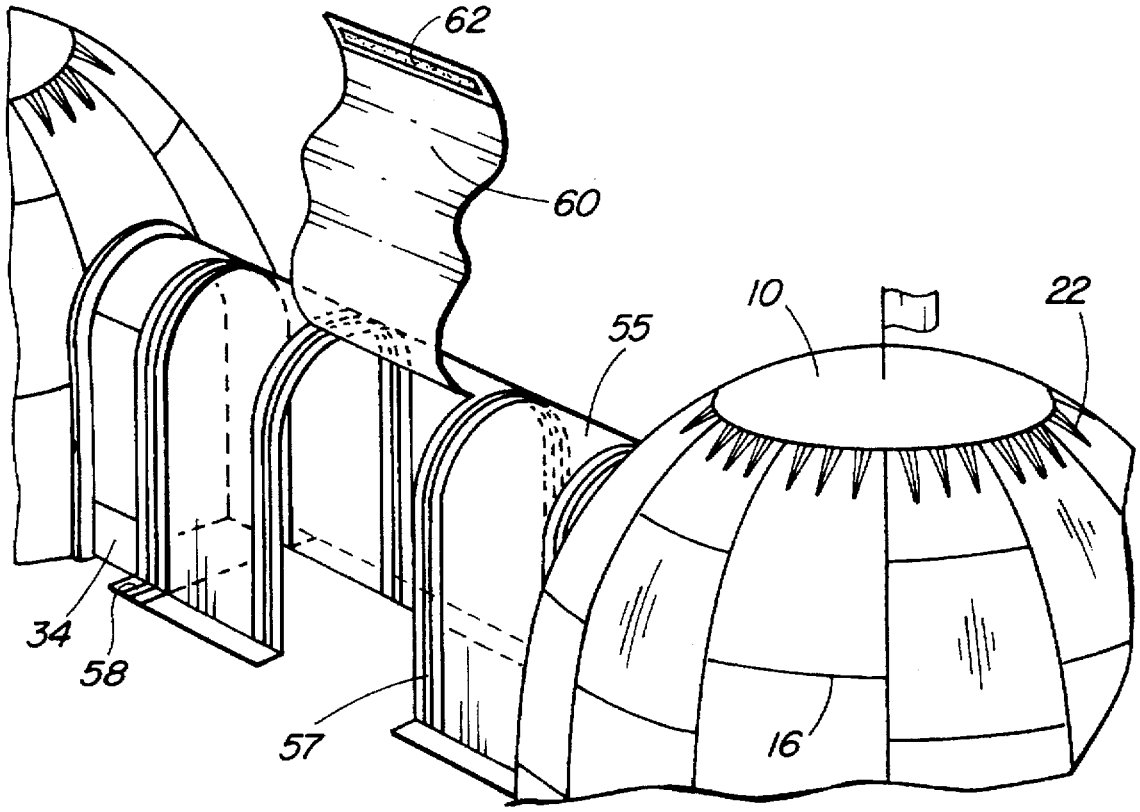
Figure 16:
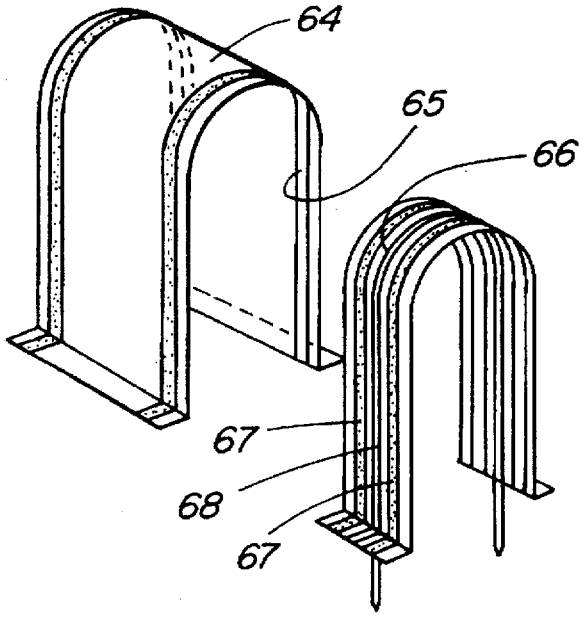
FIG. 16 is a further view of two tunnel components.

FIGS. 14, 15, and 16 show tunnel sections which can be attached onto the entranceway 34, and which may also attach onto the entranceway of another similar structure.

As shown in FIG. 14, a tunnel or passage comprises two similar components 55 each formed of a transparent plastic section bent into an arched or tunnel shape and having at one end a U-shaped rod 57 rigid enough to maintain the shape and having pointed lower ends for insertion into the ground. At the other end the inside of the tunnel component has a strip 58 of "Velcro" type hook and loop fastener material positioned to mate with a corresponding strip of material extending around the outer rim of the entranceway 34, allowing attachment of component 55 to the entranceway. Adjacent ends of the two tunnel components 55 having the rods 57 are spaced apart as shown, and are connected by a flexible, transparent plastic sheet 60 having one half of its length secured around the adjacent ends of components 55, and one half detached so as to provide a flexible door. The lower edge of this door is weighted with a heavy rod 62.

FIG. 16 shows two additional tunnel components. Component 64 is similar to component 55 but has no reinforcing rod; instead both ends have internal "Velcro" type strips 65. Component 66 is a short tunnel section with two strips of "Velcro" type material on its outside which can mate with the corresponding strips 58 or 65 on components 55 or 64, and also has a centrally placed reinforcing rod 67 with pointed end portions for engagement with the ground.

Figure 17:
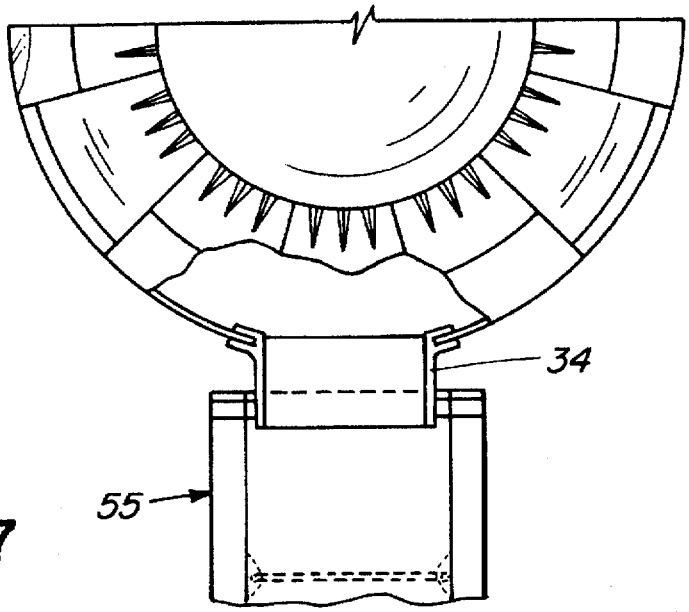
FIGS. 17 and 17*a* are top views of the entranceway and associated tunnel components.
Figure 17A:
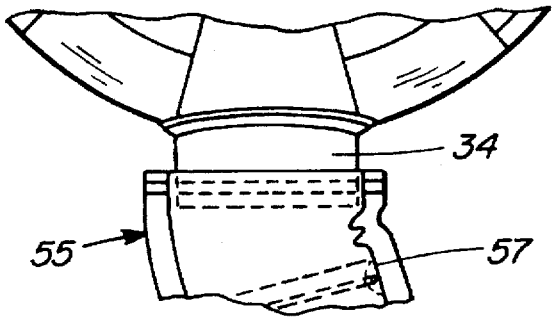

FIG. 17 shows a sectional plan view of the component 55 attached to the entranceway 34. FIG. 17*a* shows a variation of this in which the tunnel component 55 is bent; this may be needed when entranceways of two structures are not aligned with each other. To achieve this, the rod 57 is positioned at the desired off-set position before engagement with the ground.

Figure 18:
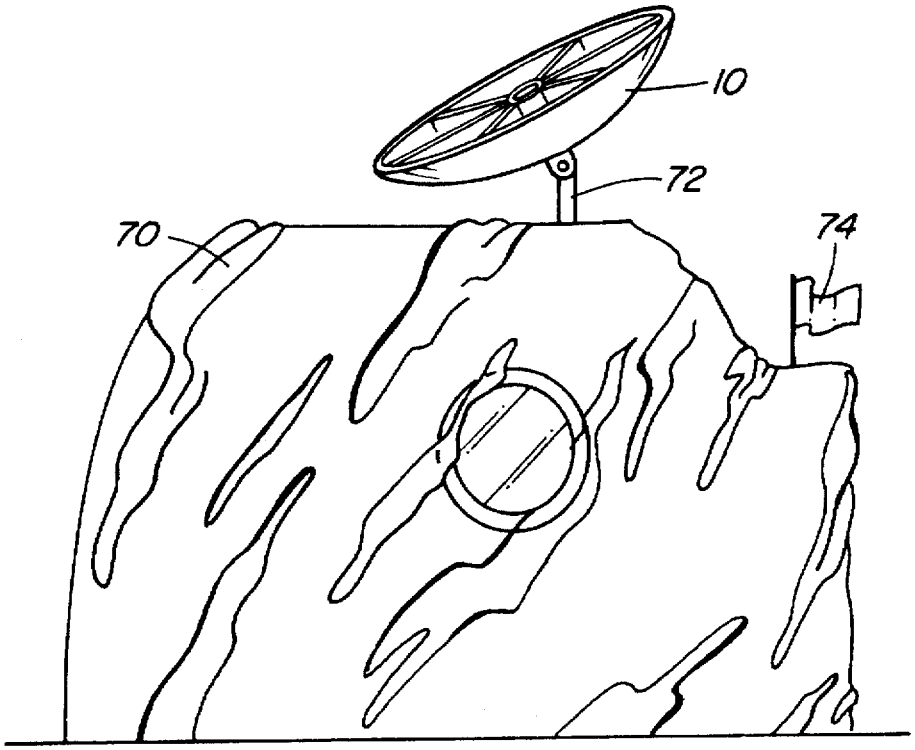
FIGS. 18 and 19 are views of the structure with components used to alter its appearance.
Figure 19:
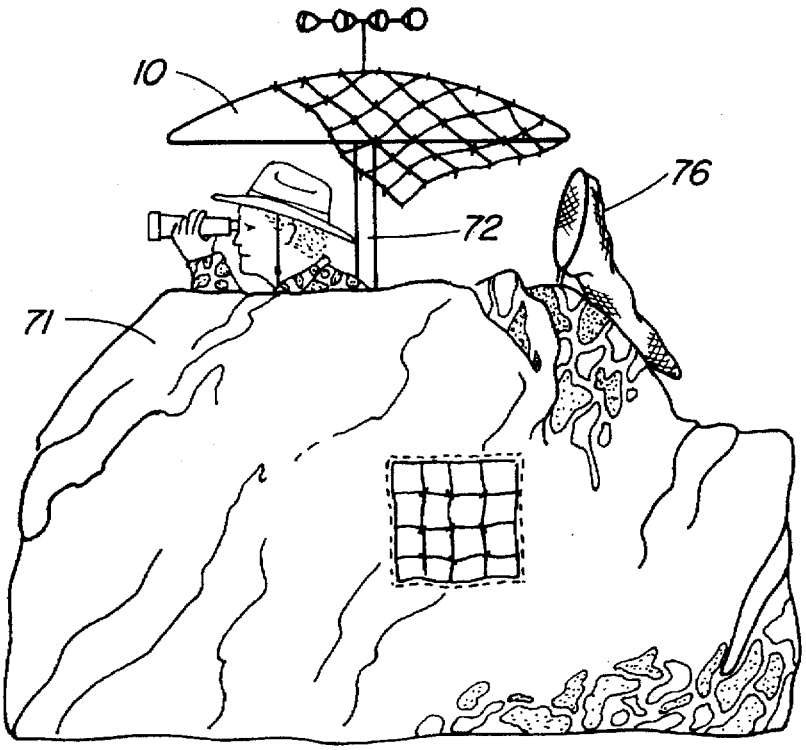

FIGS. 18 and 19 show how covers 70, 71, of printed canvas can be applied to the structure to give different appearances. In FIG. 18 the cover is designed to produce the appearance of a space laboratory. The top closure 10 is not attached as previously described; instead it is reversed and mounted on a post 72 having a swivelling part which fits into the aperture 46. A flag 74 may be added. The cover used in FIG. 19 is intended to make the structure simulate an educational facility. The top closure 10 is supported above the structure by the post 72, but is in its normal orientation. Items such as the butterfly net 76 can be added.

As well as providing a play structure, the structure can be used as a temporary shelter for hunters or other sports; and it will be apparent that the version of the structure shown in FIG. 19 is very suitable as a blind.

We claim:

1. A kit of parts for forming a structure which is at least partially of dome-like shape and which can resemble an igloo, comprising a series of side panels of generally trapezoidal shape with side edges which are at least partially bowed outwardly, said panels being initially flat but flexible along their lengths to be suitable for bending into arcuate form and for being joined edge-to-edge to adjacent side panels when curved to conform to said dome-like shape, wherein said side panels each have a main unpleated portion and an upper end portion which is provided with laterally compressible pleats to allow the upper edges of said panels to be pushed together as the panels are joined, and wherein said side edges of each side panel include edges formations comprising an undercut guideway extending all along one edge of the panel and an enlarged beading extending along the other edge of said panel allowing the panels to be connected by longitudinally sliding the beading of one panel along the undercut guideway of an adjacent similar panel, these edge formations and the outward bowing of the side edges assisting in bending the panels longitudinally during the connection of the panels.

2. A kit of parts according to claim 1, wherein said panels are formed of plastic material, and some of said panels include a line of weakening defining the outline of a window or like opening, such that an area of the panel may be cut out to provide the window or opening by cutting the panel material along said line.

3. A kit of parts according to claim 2, further comprising a transparent panel suitable for insertion into the said panel opening.

4. A kit of parts according to claim 1, including an entranceway component having a flange with an undercut groove, said groove being suitable for fitting onto the said edge formations of adjacent panels including an edge formation with the undercut guideway on one edge of one panel and the bead at the side of another panel.

5. A kit of parts according to claim 4, wherein there are provided tunnel components capable of being joined onto said entranceway component.

6. A kit of parts according to claim 1, wherein said panels include a plurality of a first type of panel and a plurality of a second type of panel, each of said types of panel having transverse ribs which can face outwardly of the structure when assembled, said ribs simulating joints between snow blocks of an igloo, the ribs of said first type of panel being set at a different height from those of said second type of panel.

7. A structure formed of a kit of parts according to claim 1, wherein upper ends of the side panels surround an aperture when the structure is assembled, and wherein said structure is provided with a top closure for said aperture, said pleated upper end portions allowing ventilation around said cover.

8. A kit of parts for forming a structure which is at least partially of dome-like shape and which can resemble an igloo, comprising a series of side panels of generally trapezoidal shape with side edges which are at least partially bowed outwardly, said panels being flexible along their lengths to be suitable for bending into arcuate form and for being joined edge-to-edge to adjacent side panels when curved to conform to said dome-like shape, wherein said side panels each have a main unpleated portion and an upper end portion which is provided with laterally compressible pleats to allow the upper edges of said panels to be pushed together as the panels are joined, and wherein said side edges of each side panel include edge formations comprising an undercut guideway extending all along one edge of the panel and an enlarged beading extending along the other edge of said panel allowing the panels to be connected by longitudinally sliding the beading of one panel along the undercut guideway of an adjacent similar panel, these edge formations and the outward bowing of the side edges assisting in bending the panels longitudinally during the assembly of the panels.

9. A kit of parts according to claim 8, wherein said panels are formed of plastic material, and some of said panels include a line of weakening defining the outline of a window or like opening, such that an area of the panel may be cut out to provide the window or opening by cutting the panel material along said line.

10. A kit of parts according to claim 9, further comprising a transparent panel suitable for insertion into the said panel opening.

11. A kit of parts according to claim 8, including an entranceway component having a flange with an undercut groove, said groove being suitable for fitting onto the said edge formations of adjacent panels including an edge formation with the undercut guideway on one edge of one panel and the bead at the side of another panel.

12. A kit of parts according to claim 11, wherein there are provided tunnel components capable of being joined onto said entranceway component.

13. A kit of parts according to claim 8, wherein said panels include a plurality of a first type of panel and a plurality of a second type of panel, each of said types of panel having transverse ribs which can face outwardly of the structure when assembled, said ribs simulating joints between snow blocks of an igloo, the ribs of first type of panel being set at a different height from those of the second type of panel.

14. A structure formed of a kit of parts according to claim 8, wherein upper ends of the side panels surround an aperture when the structure is assembled, and wherein said structure is provided with a top closure for said aperture, said pleated upper end portions allowing ventilation around said cover.

* * * * *